US009394741B2

(12) United States Patent
Phandanouvong

(10) Patent No.: US 9,394,741 B2
(45) Date of Patent: Jul. 19, 2016

(54) WINDOW JAMB LINER ASSEMBLY

(75) Inventor: Sayavongs Phandanouvong, Burnsville, MN (US)

(73) Assignee: SP Custom Carpentry & Windows, Inc., Burnsville, MN (US)

( * ) Notice: Subject to any disclaimer, the term of this patent is extended or adjusted under 35 U.S.C. 154(b) by 84 days.

(21) Appl. No.: 13/309,864

(22) Filed: Dec. 2, 2011

(65) Prior Publication Data

US 2012/0137625 A1 Jun. 7, 2012

Related U.S. Application Data

(60) Provisional application No. 61/419,391, filed on Dec. 3, 2010.

(51) Int. Cl.
*E06B 3/44* (2006.01)

(52) U.S. Cl.
CPC ..... *E06B 3/44* (2013.01); *E06B 2003/4476* (2013.01); *Y10T 16/379* (2015.01)

(58) Field of Classification Search
CPC . E06B 3/44; E06B 2003/4476; E06B 3/4609; E06B 3/4407; Y10T 16/379
USPC ..... 52/204.5, 204.1, 204.591, 204.595, 52/748.04; 49/428, 454, 414, 415, 416
See application file for complete search history.

(56) References Cited

U.S. PATENT DOCUMENTS 3,145,433 A * 8/1964 Jones ..... 49/414
5,544,450 A * 8/1996 Schmidt et al. ..... 49/419
5,671,566 A * 9/1997 Tix et al. ..... 49/419
5,887,392 A * 3/1999 Martin ..... 52/204.5
5,934,031 A * 8/1999 deNormand ..... 52/204.5
6,122,864 A * 9/2000 Martin ..... 49/428
6,305,126 B1 * 10/2001 Hendrickson et al. ..... 49/456
6,530,190 B2 * 3/2003 Conachen ..... 52/718.04
6,684,571 B2 * 2/2004 Hendrickson et al. ..... 49/428
6,883,276 B1 4/2005 Hannan et al.
7,228,660 B2 * 6/2007 Rhode et al. ..... 49/428
7,296,381 B1 * 11/2007 McCabe et al. ..... 49/454
7,552,562 B2 * 6/2009 Curtis et al. ..... 49/414
7,555,871 B1 * 7/2009 Neal ..... 52/204.51
7,631,465 B2 * 12/2009 Curtis ..... 52/204.1
7,681,360 B2 3/2010 Daniels et al.
8,096,081 B2 * 1/2012 Sees ..... 49/428
8,196,355 B1 * 6/2012 McCabe et al. ..... 49/454
2002/0023387 A1 * 2/2002 Hendrickson et al. ..... 49/1
2002/0116875 A1 * 8/2002 Gleason ..... 49/185
2004/0139659 A1 * 7/2004 Hendrickson et al. ..... 49/428

(Continued)

*Primary Examiner* — Adriana Figueroa
*Assistant Examiner* — Jessie Fonseca
(74) *Attorney, Agent, or Firm* — Vidas, Arrett & Steinkraus

(57) ABSTRACT

Techniques are described that for reducing the cost and labor associated with replacing a balance system in a window assembly if the balance system fails or needs to be upgraded. In one example, a window jamb liner assembly comprises an elongated jamb liner comprising a back wall, first and second spaced-apart interior track walls extending from the back wall, and first and second spaced-apart exterior track walls extending from the back wall, wherein the first and second spaced-apart interior track walls define an interior track, wherein the first and second spaced-apart exterior track walls define an exterior track, wherein the first and second spaced-apart interior track walls and the first and second spaced-apart exterior track walls extend substantially perpendicular to the back wall, wherein the second interior track wall terminates at a first top edge, and wherein the second exterior track wall terminates at a second top edge.

18 Claims, 6 Drawing Sheets

(56) References Cited

U.S. PATENT DOCUMENTS

2004/0139668 A1* 7/2004 Rhode et al. ..... 52/204.1
2005/0066581 A1* 3/2005 Rhode et al. ..... 49/414
2006/0150519 A1* 7/2006 Sees ..... 49/428
2006/0254151 A1* 11/2006 Curtis et al. ..... 49/414
2006/0272234 A1* 12/2006 Curtis ..... 52/204.1

* cited by examiner

WINDOW JAMB LINER ASSEMBLY

This application claims the benefit of U.S. Provisional Application No. 61/419,391, entitled, "SNAP-IN BALANCE PIECE," by Sayavongs Phandanouvong, and filed on Dec. 3, 2010, the entire contents of which being incorporated herein by reference.

TECHNICAL FIELD

The disclosure relates to window construction and, more particularly, to window jamb liners.

BACKGROUND

The jamb liner is a rigid component of a window which is installed vertical to a window frame on the left and right of two window sashes. The function of the jamb liner is to house a spring-loaded balance system in an enclosed track. The spring supports the weight of the sash and allows the window to open and close. Each sash has its own set of tracks which allows the sash, with the assistance of the balance system, e.g., spring loaded balance system, to move up and down. The sashes are integrated with the balance system via a set of pivot bars. The pivot bars allow the sash to rotate, subsequently locking the balance system in place.

SUMMARY

In general, this disclosure describes techniques for reducing the cost and labor associated with replacing a balance system in a window assembly if the balance system fails or needs to be upgraded, e.g., replacement sashes require a new balance system.

In one example, this disclosure is directed to a window jamb liner assembly comprising an elongated jamb liner comprising a back wall, first and second spaced-apart interior track walls extending from the back wall, and first and second spaced-apart exterior track walls extending from the back wall, wherein the first and second spaced-apart interior track walls define an interior track, wherein the first and second spaced-apart exterior track walls define an exterior track, wherein the first and second spaced-apart interior track walls and the first and second spaced-apart exterior track walls extend substantially perpendicular to the back wall, wherein the second interior track wall terminates at a first top edge, and wherein the second exterior track wall terminates at a second top edge.

In another example, this disclosure is directed to a window frame comprising a head member, a sill member, and a pair of elongated jamb liners arranged in rectangular configuration. Each jamb liner comprises a back wall, first and second spaced-apart interior track walls extending from the back wall, and first and second spaced-apart exterior track walls extending from the back wall, wherein the first and second spaced-apart interior track walls define an interior track, wherein the first and second spaced-apart exterior track walls define an exterior track, wherein the first and second spaced-apart interior track walls and the first and second spaced-apart exterior track walls extend substantially perpendicular to the back wall, wherein the second interior track wall terminates at a first top edge, and wherein the second exterior track wall terminates at a second top edge.

In another example, this disclosure is directed to a window jamb liner assembly comprising an elongated jamb liner comprising a back wall, first and second spaced-apart interior track walls extending from the back wall, and first and second spaced-apart exterior track walls extending from the back wall, wherein the first and second spaced-apart interior track walls define an interior track, wherein the first and second spaced-apart exterior track walls define an exterior track, wherein the first and second spaced-apart interior track walls and the first and second spaced-apart exterior track walls extend substantially perpendicular to the back wall, wherein the second interior track wall has a top edge free from engagement, wherein the second exterior track wall has a top edge free from engagement, wherein the top edge of the second interior track wall comprises a first hooked end, wherein the top edge of the second exterior track wall comprises a second hooked end. wherein the second interior track wall has a first longitudinal axis, wherein the first hooked end is longitudinally aligned with the first longitudinal axis, wherein the second interior track wall has a second longitudinal axis, wherein the second hooked end is longitudinally aligned with the second longitudinal axis, wherein the second interior track wall and the second exterior track wall define a channel. The assembly further comprises a jamb liner cover configured to engage the second interior track wall and the second exterior track wall and extend at least partially into the channel, the jamb liner cover comprises a base, and first and second cover walls that extend substantially perpendicular to the base, wherein the first cover wall comprises a third hooked end, wherein the second cover wall comprises a fourth hooked end, and wherein the third and fourth hooked ends are configured to engage the first and second hooked ends to secure the cover wall to the jamb liner.

The details of one or more aspects of the disclosure are set forth in the accompanying drawings and the description below. Other features, objects, and advantages will be apparent from the description and drawings, and from the claims.

DETAILED DESCRIPTION

This disclosure generally describes jamb liner assemblies and window assemblies that utilize the jamb liner assemblies described in this disclosure. In some examples, the techniques described in this disclosure are effective in reducing the cost and labor associated with replacing the balance system if the balance system fails or needs to be upgraded, e.g., replacement sashes require a new balance system.

Many existing jamb liners effectively seal off all access to the balance system once the jamb liner is installed. If any portion of the balance system fails or needs to be upgraded, e.g., spring, shoe, etc., the only way to replace the balance system is to un-install the window unit including the jamb liner. Typically, the jamb liner must be pried loose from the frame of the window opening, which may damage the frame and/or the jamb liner, and is a time-consuming process. It should be noted that "jamb liner" and "jamb liner assembly" are used interchangeably throughout this disclosure.

In accordance with some example techniques of this disclosure, a jamb liner assembly is disclosed that allows for the balance system to be accessed after installation of the jamb liner assembly. In particular, the jamb liner assembly described in this disclosure engages with a jamb liner cover that can be removed, thereby allowing the defective balance or other parts to be removed and replaced without un-installing the jamb liner assembly or window frame.

Figure 1:
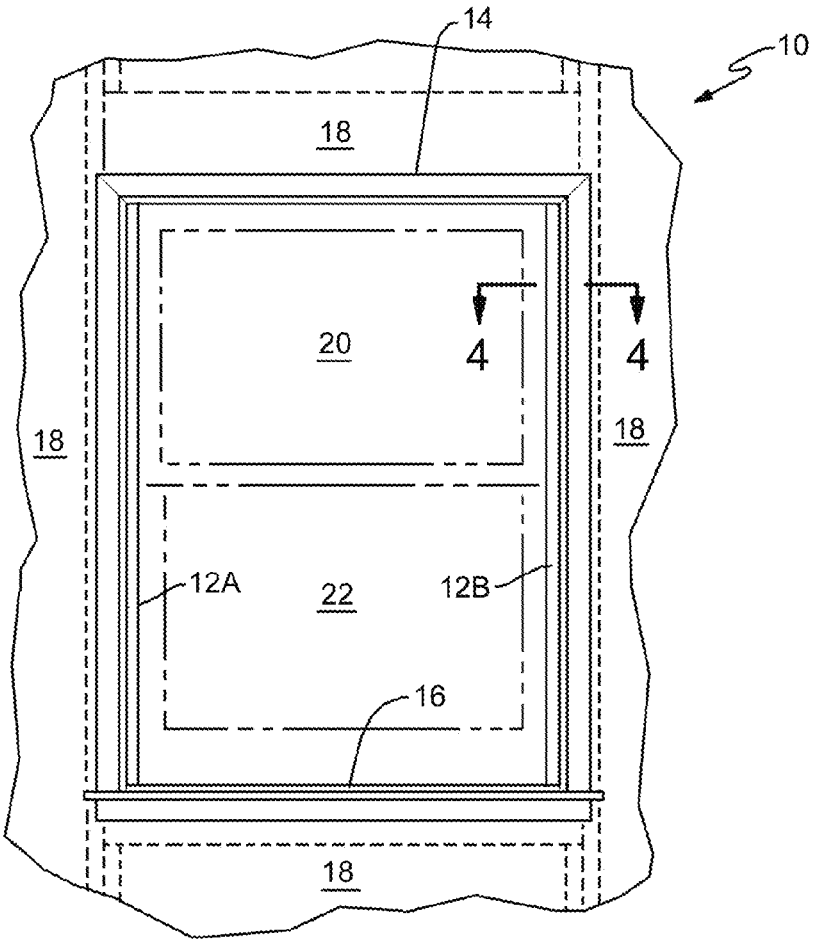
FIG. 1 is a front elevational view of a sash window assembly that includes a jamb liner assembly using the techniques of this disclosure.

FIG. 1 is a front elevational view of a sash window assembly that includes a jamb liner using the techniques of this disclosure. In particular, FIG. 1 depicts window assembly 10 that includes two elongate jamb liner assemblies 12A, 12B (collectively referred to in this disclosure as "jamb liner assemblies 12") extending between and forming a rectangular configuration with head member 14 and sill member 16. Jamb liner assemblies 12, head member 14, and sill member 16 are fastened, e.g., via nails or screws, to window opening frame 18. Window assembly 10 further includes two sashes, namely upper sash 20 and lower sash 22. Jamb liner assemblies 12 and, in particular, balance systems (not shown in FIG. 1) installed within jamb liner assemblies 12 counter-balance the weight of sashes 20, 22, thereby supporting the sashes within the window assembly.

Using the techniques of this disclosure, the balance systems installed within jamb liner assemblies 12 may be removed and replaced without removing a jamb liner assembly from window opening frame 18. As described in more detail below, a jamb liner cover can be removed from the jamb liner assembly, thereby allowing the defective balance or other parts to be removed and replaced without un-installing the jamb liner assembly or window frame.

Figure 2:
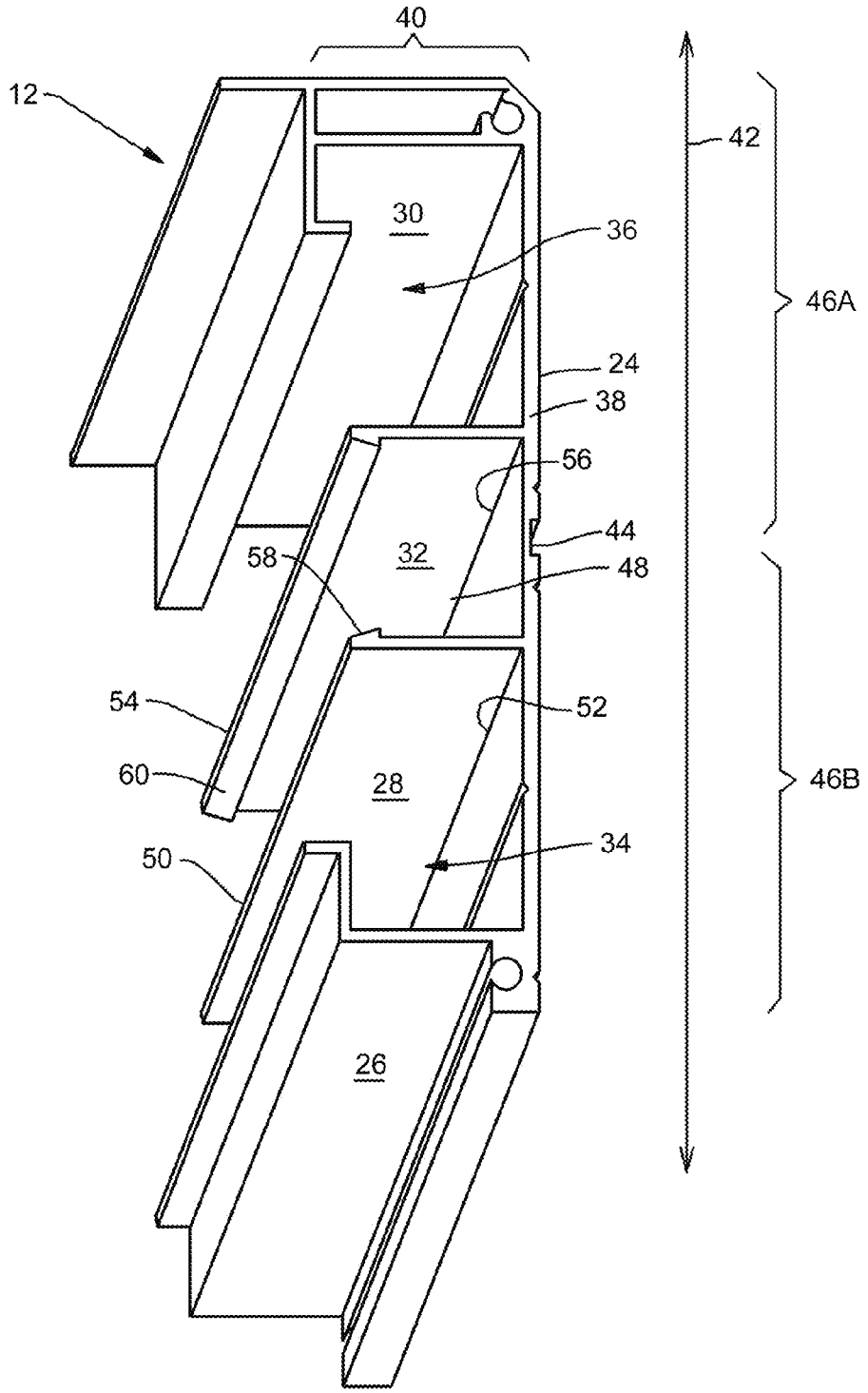
FIG. 2 is a perspective view illustrating a portion of an example jamb liner assembly using the techniques of this disclosure.

FIG. 2 is a perspective view illustrating a portion of an example jamb liner assembly using the techniques of this disclosure. Jamb liner assembly 12 includes back wall 24, first and second spaced-apart interior track walls 26, 28, respectively, and first and second spaced-apart exterior track walls 30, 32, respectively. As seen in FIG. 2, each of first and second spaced-apart interior track walls 26, 28 and first and second spaced-apart exterior track walls 30, 32 extend from back wall 24.

In some example configurations, as shown in FIG. 2, jamb liner 12 may be formed by extrusion techniques, e.g., extruded aluminum, such that first and second spaced-apart interior track walls 26, 28, first and second spaced-apart exterior track walls 30, 32, and back wall 24 are a single piece of material. In other example configurations, first and second spaced-apart interior track walls 26, 28, first and second spaced-apart exterior track walls 30, 32, and back wall 24 may be separate components engaged to one another to form jamb liner assembly 12. In one example, jamb liner assembly 12 is extruded aluminum wrapped in wood to provide a more natural look to the assembly. In other example configurations, jamb liner 12 may be made of vinyl, for example, rather than aluminum.

First and second spaced-apart interior track walls 26, 28 define an interior track, shown generally at 34, and first and second spaced-apart exterior track walls define an exterior track, shown generally at 36. Generally, interior track 34 supports lower sash 22 (FIG. 1) and exterior track 36 support upper sash 30 (FIG. 1). In one example configuration, back wall 24 has a thickness, shown at 38, first exterior track wall 30 has a depth, shown at 40, and the combination of the thickness and depth is about 0.7 inches to about 1 inch.

In the example configuration depicted in FIG. 2, back wall 24 extends continuously along a single longitudinal axis, shown generally at 42. A portion of back wall thickness 38 defines notch 44 that extends the length of back wall 24. Notch 44 defines a thermal break point that allows the jamb liner to be divided into two portions 46A, 46B. In other words, jamb liner 12 can be split into two portions 46A, 46B along notch 44, thereby allowing jamb liner 12 to be used for wider sashes, e.g., a sash having a width of 1¾ inch. In this manner, jamb liner 12 and, in particular tracks 34 and 36 can accommodate, for example, standard sashes, e.g., having a width of 1⅜ inch or, when split along notch 44, wider sashes, e.g., having a width of 1¾ inch.

In FIG. 2, second interior track wall 28 and second exterior track wall 32 extend parallel to one another and are substantially perpendicular to back wall 24. Second interior track wall 28 and second exterior track wall 32 define a longitudinal channel therebetween, shown generally at 48. Channel 48 is further defined by a portion of back wall 24. As indicated above, in some example configurations, back wall 12 extends continuously along longitudinal axis 42.

Second interior track wall 28 has top edge 50 and bottom edge 52, and second exterior track wall 32 has top edge 54 and bottom edge 56. As seen in FIG. 2, each top edge 50, 54 is substantially vertically aligned with a respective bottom edge 52, 56. In addition, second interior track wall 28 and second exterior track wall 32 terminate at top edges 50, 54, respectively.

In some example configurations, each top edge 50, 54 includes a hooked end, as depicted in FIG. 2. In particular, top edge 50 includes hooked end 58 and top edge 54 includes hooked end 60. Hooked ends 58, 60 may be barb-shaped such that the hooked ends taper from a wider portion to a narrower portion. As shown and described in more detail below, hooked ends 58, 60 are configured to matingly engage hooked ends on a jamb liner cover, thereby securing the jamb liner cover to jamb liner 12.

Figure 3:
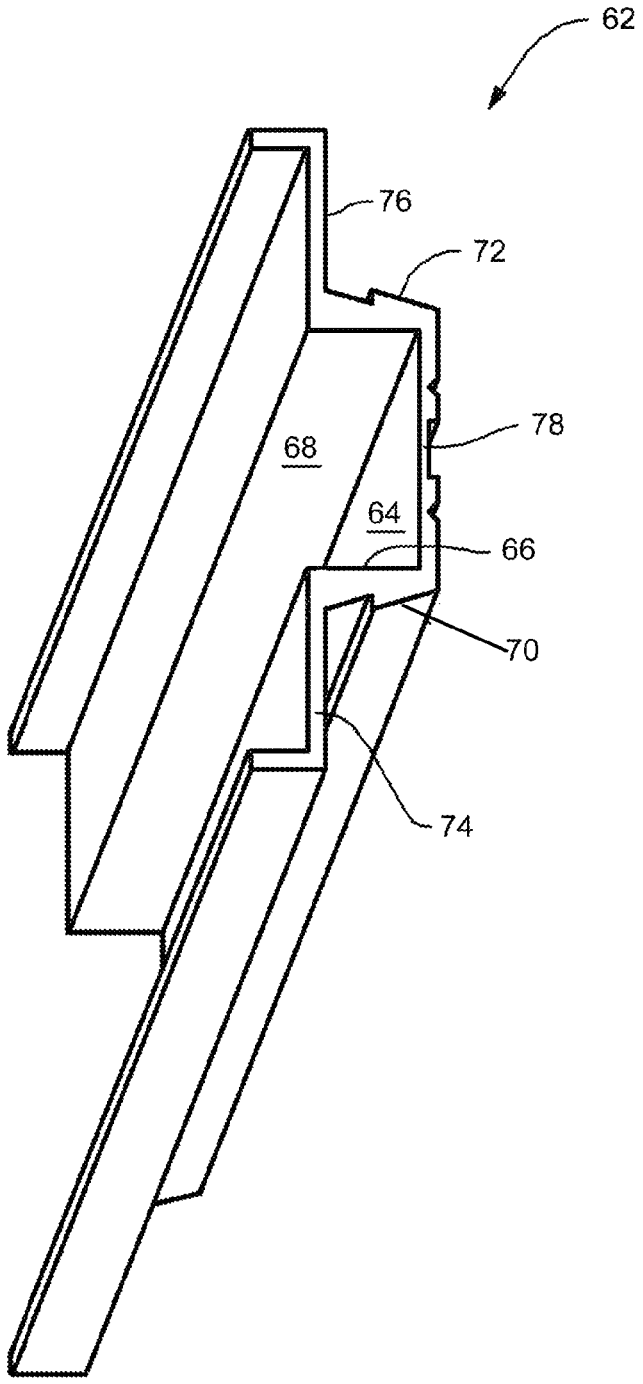
FIG. 3 is a perspective view illustrating a portion of an example jamb liner cover using the techniques of this disclosure.

FIG. 3 is a perspective view illustrating a portion of an example jamb liner cover using the techniques of this disclosure. Jamb liner cover 62 includes base 64, first cover wall 66, and second cover wall 68. Jamb liner cover 62 is configured to engage second interior track wall 28 and second exterior track wall 32 and extend at least partially into channel 48 of jamb liner assembly 12.

In one example configuration, such as depicted in FIG. 3, first cover wall 66 comprises first hooked portion 70 and second cover wall 68 comprises second hooked portion 72. First and second hooked portions are configured to engage the first and second hooked ends 58, 60 of jamb liner 12 to secure cover walls 66, 68 and cover 62 to jamb liner 12.

In accordance with this disclosure, cover 62 is removably engaged to second interior track wall 28 and second exterior track wall 32, thereby allowing a user to replace one or more balance systems (shown at 82, 84 in FIG. 4) of window assembly 10 (FIG. 1) without removing jamb liner assembly 12 from window opening frame 18. That is, one or more balance systems of window assembly 10 may be removed without detaching back wall 24 from window opening frame 18. In order to further define a track, e.g., interior track 34 and exterior track 36, in which a sash, e.g., upper sash 20 or lower sash 22, may be positioned, jamb liner cover 62 further includes two retaining portions, namely first retaining portion 74 and second retaining portion 76. As shown below in FIG. 4, first retaining portion 74 extends over second interior track wall 28 and further defines interior track 34, and second retaining portion 76 extends over second exterior track wall 32 and further defines exterior track 36.

It should be noted that first and second hooked portions 70, 72 are only one way of fastening jamb liner cover 62 to jamb liner 12. Other example means for securing jamb liner cover 62 to jamb liner 12 include, but are not limited to releasable adhesives, springs clips, plastic plugs, as well as screws and other mechanical fasteners.

As described above, in some example configurations, a portion of the thickness of back wall 24 defines a thermal break point, namely notch 44, that extends the length of back wall 24 and that allows jamb liner 12 to be divided into two portions. In one example configuration, jamb liner cover 62 may include a cover notch 78 that extends the length of cover 62, thereby allowing jamb liner cover 62 to also be divided into two portions. When split along cover notch 78, cover 62 can accommodate sashes having greater than standard widths, e.g., a sash having a width of 1¾ inch.

Figure 4:
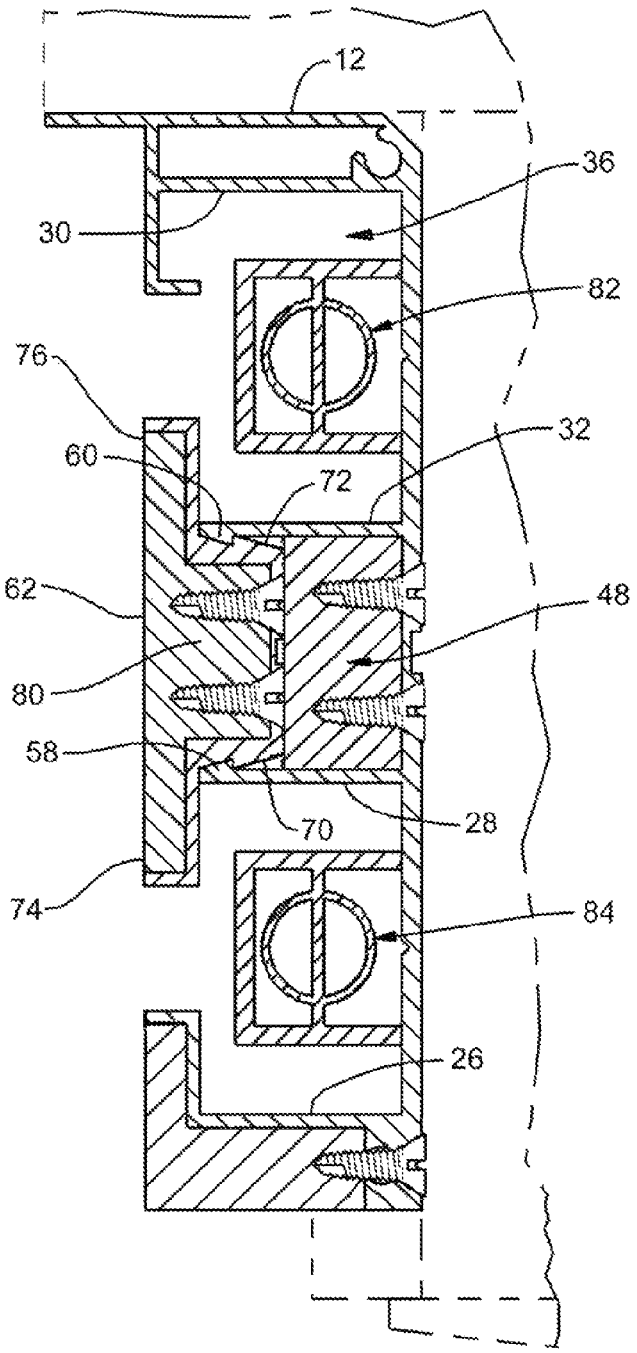
FIG. 4 is a sectional view illustrating an example jamb liner assembly and cover in combination, in accordance with this disclosure.

FIG. 4 is a sectional view illustrating an example jamb liner assembly and cover in combination, in accordance with this disclosure. In particular, FIG. 4 depicts jamb liner assembly 12 of FIG. 2 in combination with jamb liner cover 62 of FIG. 3. As seen in FIG. 4, first and second hooked portions 58, 60 of jamb liner 12 engage first and second hooked ends 70, 72, respectively, of jamb liner cover 62. A portion of cover 62 extends into channel 48 defined by back wall 24, second interior track wall 28, and second exterior track wall 32. In addition, first retaining portion 74 extends over second interior track wall 28 and further defines interior track 34, and second retaining portion 76 extends over second exterior track wall 32 and further defines exterior track 36.

Jamb liner cover 62 may further include filler 80. Filler 80 may be wood, metal, or a combination of wood and metal, e.g., wood wrapped in aluminum. In one example configuration, a first length of jamb liner cover 62 may include a wood filler as shown below in FIG. 4 at 80, e.g., a portion that will be positioned in the interior of the home, and a second length of jamb liner cover 62 may include filler 80 that is a combination of wood and metal, e.g., a portion of wood wrapped in metal that will be positioned on the exterior of the home (not shown).

FIG. 4 further depicts two balance systems, namely upper sash balance system 82 and lower sash balance system 84. Upper sash balance system 82 is positioned within exterior track 36 and lower sash balance system 84 is positioned within exterior track 36. In accordance with this disclosure, once either or both of upper and lower sashes 20, 22 (FIG. 1) have been removed, jamb liner cover 62 may be removed, e.g., using a pry bar, screwdriver, or the like, thereby further exposing either or both of upper sash balance system 82 and lower sash balance system 84. Once either or both of upper sash balance system 82 and lower sash balance system 84 have been exposed, a user may easily remove and replace one or both balance systems of window assembly 10 (FIG. 1) without removing jamb liner assembly 12 from window opening frame 18.

Figure 5:
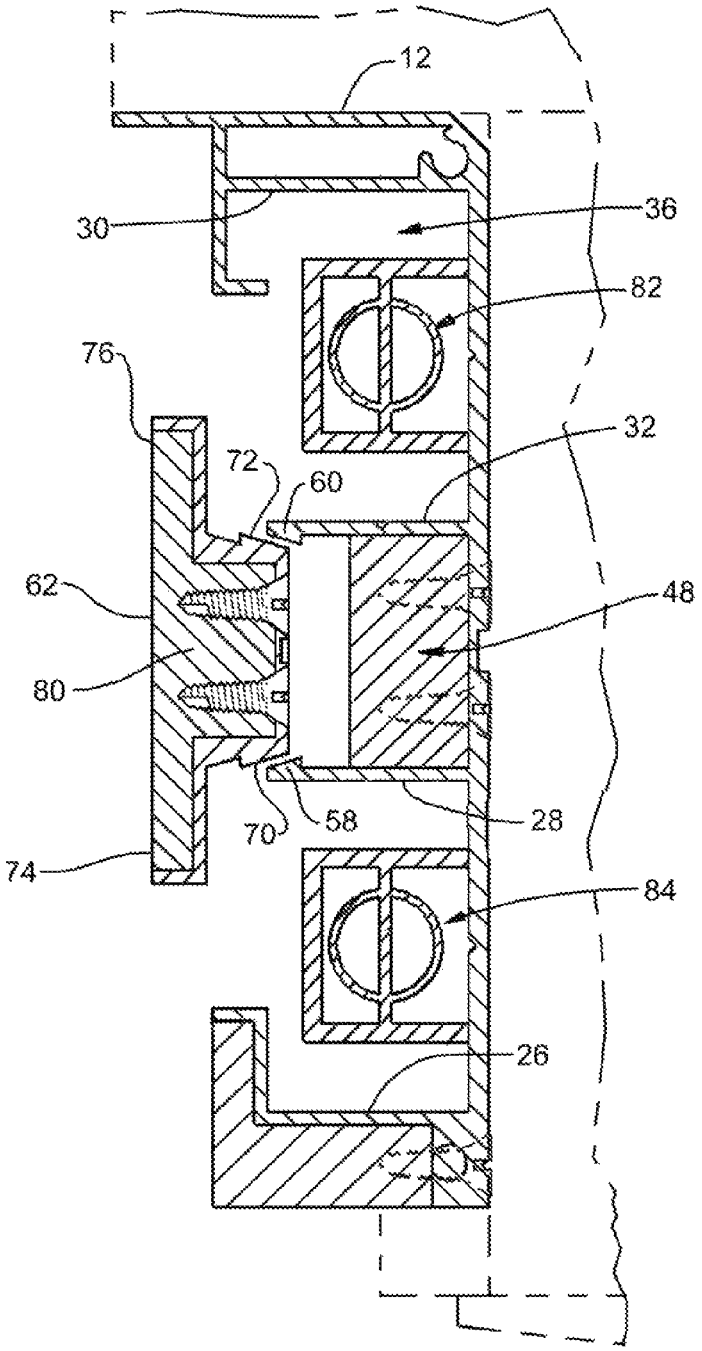
FIG. 5 is a sectional view illustrating an example jamb liner assembly and cover, in accordance with this disclosure.

FIG. 5 is a sectional view illustrating an example jamb liner assembly and cover, in accordance with this disclosure. More particularly, FIG. 5 depicts jamb liner cover 62 immediately prior to installation within channel 48 (or immediately after removal from channel 48). First and second hooked portions 58, 60 of jamb liner 12 are disengaged from first and second hooked ends 70, 72, respectively, of jamb liner cover 62. Cover 62 no longer extends into channel 48 defined by back wall 24, second interior track wall 28, and second exterior track wall 32. In addition, as cover 62 is removed, first retaining portion 74 and second retaining portion 76 of cover 62 no longer extend over and define interior track 34 and exterior track 36, thereby allowing removal of one or both balance systems of window assembly 10 (FIG. 1) without removing jamb liner assembly 12 from window opening frame 18.

Figure 6:
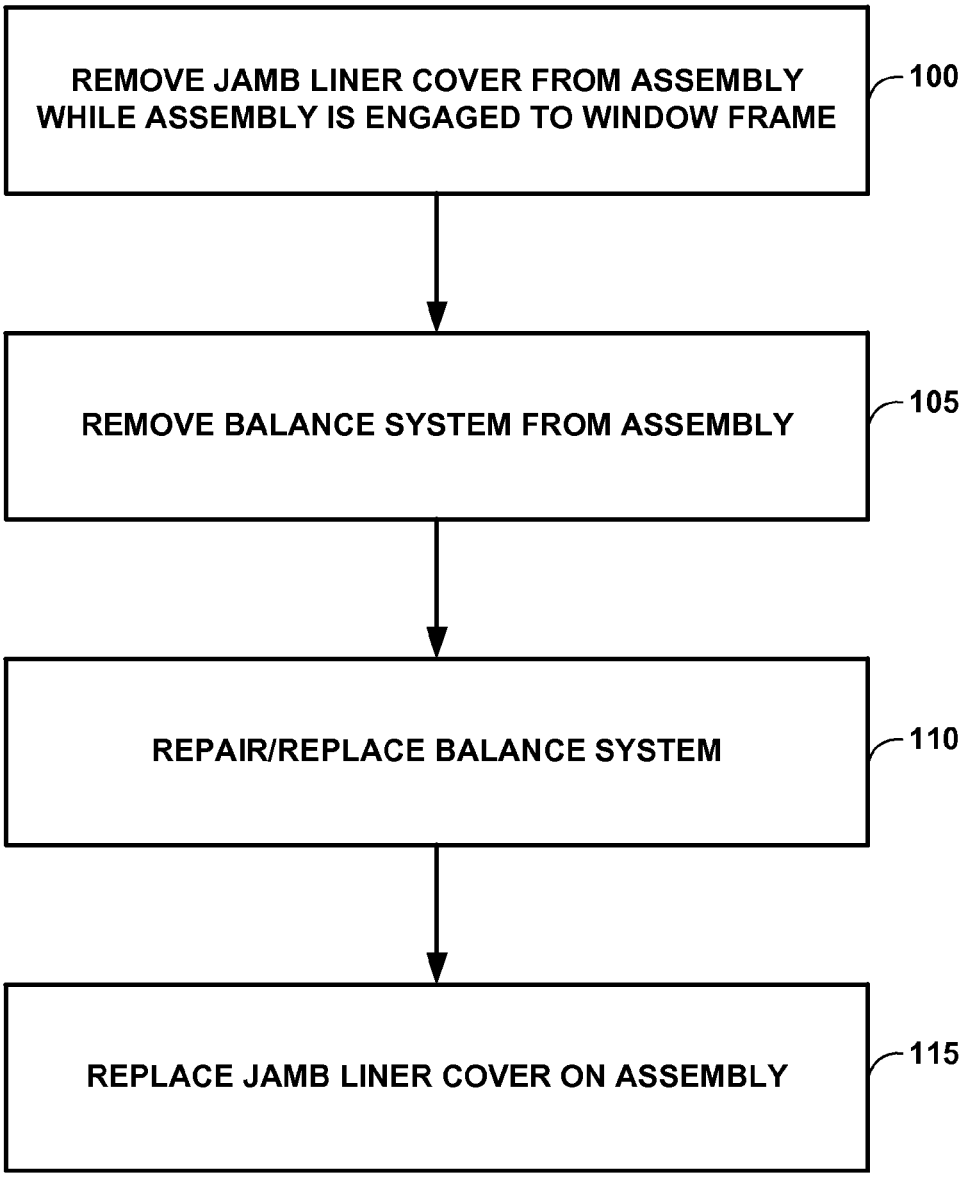
FIG. 6 is a flow chart depicting one example method of replacing a balance system in accordance with this disclosure.

FIG. 6 is a flow chart illustrating one example method of replacing a balance system in accordance with this disclosure. In FIG. 6, a user removes jamb liner cover 62, e.g., using a pry bar, screw driver, or the like, from jamb liner assembly 12 (100). In particular, a user disengages first and second hook ends 58, 60 of jamb liner assembly 12 from first and second hooked portions 70, 72 of jamb liner cover 62. Once jamb liner cover 62 is separated from jamb liner assembly 10, a user may remove a balance system, e.g., one or both of balance systems 82, 84 of FIG. 4, without removing jamb liner assembly 10 from window opening frame 18 (105). The user may repair or replace the balance system, and then install the new balance system within a track without removing jamb liner assembly 10 from window opening frame 18 (110). After installing the balance system, a user may re-attach cover 62 to jamb liner assembly 10 (115). In one example, this disclosure is directed to the example method depicted in FIG. 6.

Various aspects of the disclosure have been described. These and other aspects are within the scope of the following claims.

The invention claimed is:

1. A window jamb liner assembly comprising:

an elongated jamb liner comprising a back wall, first and second spaced-apart interior track walls extending from the back wall, and first and second spaced-apart exterior track walls extending from the back wall, wherein the first and second spaced-apart interior track walls define an interior track, wherein the first and second spaced-apart exterior track walls define an exterior track, wherein the first and second spaced-apart interior track walls and the first and second spaced-apart exterior track walls extend substantially perpendicular to the back wall, wherein the second interior track wall terminates at a first top edge, wherein the second exterior track wall terminates at a second top edge;

wherein the top edge of the second interior track wall comprises a first hooked end;

wherein the second interior track wall and the second exterior track wall define a channel, the assembly further comprising:

a jamb liner cover configured to engage the second interior track wall and the second exterior track wall and extend at least partially into the channel, wherein the jamb liner cover comprises:

a base; and first and second cover walls that extend substantially perpendicular to the base, the first cover wall comprising a first hooked portion; and wherein the base as a whole is located closer to the back wall than the first hooked portion when the jamb liner cover engages the second interior track wall and the second exterior track wall.

2. The assembly of claim 1, wherein the top edge of the second exterior track wall comprises a second hooked end.

3. The assembly of claim 2, wherein the second interior track wall has a first longitudinal axis, wherein the first hooked end is longitudinally aligned with the first longitudinal axis, wherein the second interior track wall has a second longitudinal axis, and wherein the second hooked end is longitudinally aligned with the second longitudinal axis.

4. The assembly of claim 2, wherein the second cover wall comprises a second hooked portion, and wherein the first and second hooked portions are configured to engage the first and second hooked ends to secure the cover walls to the jamb liner.

5. The assembly of claim 1, wherein a first portion of the jamb liner cover extends over the second interior track wall, wherein a second portion of the jamb liner cover extends over the second exterior track wall, and wherein the first portion and the second portion further define the interior track and the exterior track, respectively.

6. The assembly of claim 1, wherein the back wall has a thickness, wherein the first exterior track wall has a depth, and wherein the combination of the thickness and depth is about 0.7 inches to about 1 inch.

7. The assembly of claim 1, wherein the back wall has a thickness and a length, wherein a portion of the thickness defines a notch extending the length of the back wall, wherein the notch defines a thermal break point for dividing the jamb liner into two portions.

8. The assembly of claim 1, further comprising a first balance assembly and a second balance assembly, wherein the assemblies are configured to fit within the interior track and the exterior track.

9. A window frame comprising:

a head member, a sill member, and a pair of elongated jamb liners arranged in rectangular configuration, wherein the each jamb liner comprises:

a back wall, first and second spaced-apart interior track walls extending from the back wall, and first and second spaced-apart exterior track walls extending from the back wall, wherein the first and second spaced-apart interior track walls define an interior track, wherein the first and second spaced-apart exterior track walls define an exterior track, wherein the first and second spaced-apart interior track walls and the first and second spaced-apart exterior track walls extend substantially perpendicular to the back wall, wherein the second interior track wall terminates at a first top edge, and wherein the second exterior track wall terminates at a second top edge;

wherein the top edge of the second interior track wall comprises a first hooked end;

wherein the second interior track wall and the second exterior track wall define a channel, the assembly further comprising:

a jamb liner cover configured to engage the second interior track wall and the second exterior track wall and extend at least partially into the channel, wherein the jamb liner cover comprises:

a base; and first and second cover walls that extend substantially perpendicular to the base, the first cover wall comprising a first hooked portion; and wherein the base as a whole is located closer to the back wall than the first hooked portion when the jamb liner cover engages the second interior track wall and the second exterior track wall.

10. The frame of claim 9, wherein the top edge of the second exterior track wall comprises a second hooked end.

11. The frame of claim 10, wherein the second interior track wall has a first longitudinal axis, wherein the first hooked end is longitudinally aligned with the first longitudinal axis, wherein the second interior track wall has a second longitudinal axis, and wherein the second hooked end is longitudinally aligned with the second longitudinal axis.

12. The frame of claim 10, wherein the second cover wall comprises a second hooked portion, and wherein the first and second hooked portions are configured to engage the first and second hooked ends to secure the cover walls to the jamb liner.

13. The frame of claim 9, wherein a first portion of the jamb liner cover extends over the second interior track wall, wherein a second portion of the jamb liner cover extends over the second exterior track wall, and wherein the first portion and the second portion further define the interior track and the exterior track, respectively.

14. The frame of claim 9, wherein the back wall has a thickness, wherein the first exterior track wall has a depth, and wherein the combination of the thickness and depth is about 0.7 inches to about 1 inch.

15. The frame of claim 9, wherein the back wall has a thickness and a length, wherein a portion of the thickness defines a notch extending the length of the back wall, wherein the notch defines a thermal break point for dividing the jamb liner into two portions.

16. The frame of claim 9, further comprising a first balance assembly and a second balance assembly, wherein the assemblies are configured to fit within the interior track and the exterior track.

17. A window jamb liner assembly comprising:

an elongated jamb liner comprising a back wall, first and second spaced-apart interior track walls extending from the back wall, and first and second spaced-apart exterior track walls extending from the back wall, wherein the first and second spaced-apart interior track walls define an interior track, wherein the first and second spaced-apart exterior track walls define an exterior track, wherein the first and second spaced-apart interior track walls and the first and second spaced-apart exterior track walls extend substantially perpendicular to the back wall, wherein the second interior track wall has a top edge free from engagement, wherein the second exterior track wall has a top edge free from engagement, wherein the top edge of the second interior track wall comprises a first hooked end, wherein the top edge of the second exterior track wall comprises a second hooked end, wherein the second interior track wall has a first longitudinal axis, wherein the first hooked end is longitudinally aligned with the first longitudinal axis, wherein the second interior track wall has a second longitudinal axis, wherein the second hooked end is longitudinally aligned with the second longitudinal axis, wherein the second interior track wall and the second exterior track wall define a channel, the assembly further comprising:

a jamb liner cover configured to engage the second interior track wall and the second exterior track wall and extend at least partially into the channel, the jamb liner cover comprising:

a base; and first and second cover walls that extend substantially perpendicular to the base, wherein the first cover wall comprises a third hooked end, wherein the second cover wall comprises a fourth hooked end, and wherein the third and fourth hooked ends are configured to engage the first and second hooked ends to secure the cover walls to the jamb liner; and wherein the base as a whole is located closer to the back wall than the first hooked portion when the jamb liner cover engages the second interior track wall and the second exterior track wall.

18. The assembly of claim 17, wherein a first portion of the jamb liner cover extends over the second interior track wall, wherein a second portion of the jamb liner cover extends over the second exterior track wall, and wherein the first portion and the second portion further define the interior track and the exterior track, respectively.

* * * * *